US005516095A

United States Patent [19]

Bacik et al.

[11] Patent Number: 5,516,095

[45] Date of Patent: May 14, 1996

[54] ECCENTRIC ROLLER ASSEMBLY FOR BELTED INFEED

[75] Inventors: John Bacik, Strongsville, Ohio; Charles T. Lynch, Murrysville, Pa.

[73] Assignee: Quipp Systems, Inc., Miami, Fla.

[21] Appl. No.: 286,945

[22] Filed: Aug. 8, 1994

[51] Int. Cl.[6] ..... B65H 29/70; B65H 5/02

[52] U.S. Cl. ..... 271/272; 271/188

[58] Field of Search ..... 271/272, 273, 271/275, 188, 198, 314, 209, 161

[56] References Cited

U.S. PATENT DOCUMENTS

| | | | |
|---|---|---|---|
| 415,267 | 11/1889 | Hart | 271/188 |
| 2,157,228 | 5/1939 | Buccicone et al. | 271/188 |
| 4,162,733 | 7/1979 | Wiseman . | |
| 4,964,627 | 10/1990 | Watts et al. . | |
| 5,209,466 | 5/1993 | Watts et al. | 271/188 |

FOREIGN PATENT DOCUMENTS

| | | | |
|---|---|---|---|
| 0123834 | 9/1980 | Japan | 271/272 |
| 0192661 | 8/1989 | Japan | 271/188 |
| 0023153 | 1/1991 | Japan | 271/188 |
| 3-143865 | 6/1991 | Japan | 271/209 |
| 404064568 | 2/1992 | Japan | 271/188 |
| 406040592 | 2/1994 | Japan | 271/273 |

*Primary Examiner*—H. Grant Skaggs
*Attorney, Agent, or Firm*—Louis Weinstein

[57] ABSTRACT

Uniform diameter rollers are used with eccentric members to impart a V-shape to a signature stream in the infeed section of a stacker. At least one of the rollers of the shaft includes an eccentric member to offset the rotational axis of that roller. A roller of the second set provided on a second shaft is similarly offset so that sheet product fed between the rollers will be bent to add rigidity and stiffness to the signature stream.

25 Claims, 3 Drawing Sheets

ECCENTRIC ROLLER ASSEMBLY FOR BELTED INFEED

BACKGROUND OF THE INVENTION

This invention pertains to the art of infeed mechanisms, and more particularly to infeed conveyors for stackers such as newspaper or signature stackers that receive a lapped or imbricated stream of sheet products. The invention is particularly applicable to infeed conveyors that form a non-planar or V-shaped configuration to the product as it passes therethrough and will be described with particular reference thereto. However, it will be appreciated that the invention has broader applications and may be advantageously employed in other environments and applications where greater control of sheet-like products or articles is required.

A commercially successful stacker is shown and described in U.S. Patent No. 4,162,733. The '733 patent describes particular details of the infeed mechanism which includes a set of rollers disposed in a V-shaped configuration by mounting generally cylindrical rollers on inclined shafts. As described therein, the infeed mechanism of this commercial device includes a set of flexible continuous loop members such as coil spring wires that extend around the rollers. The rollers include plural circumferential grooves that receive the coil spring wires. Upper and lower conveyors receive the stream of newspapers or similar flat articles. Typically, the lower conveyor can be pivoted in a downward fashion to define a dump gate if a jam condition is detected during operation. Once the jam is cleared, or during normal operation, the second or lower conveyor is brought into an upper, operative position where it is properly spaced beneath the upper conveyor to receive the sheet products therethrough.

The upper and lower V-rollers impart a non-planar or V-shaped configuration to the products. As is well known in the art, bending a sheet product facilitates handling by providing better alignment, feeding, enhanced rigidity, uniform handling, and the like by stiffening the sheet products.

U.S. Pat. No. 4,964,627 describes another arrangement for forming sheet product into a V-shaped configuration. Specifically, different length and different diameter rollers are arranged on cooperating shafts to define the V-shape necessary to enhance the stiffness or rigidity of the sheet product. More particularly, the shafts are disposed in generally horizontal, parallel relation. An outer pair of elongated, small diameter rollers are mounted on the first shaft. A central enlarged diameter, shortened roller is interposed between the outer rollers. The reverse configuration is provided on the second shaft. That is, the pair of outer rollers have an enlarged diameter and are relatively short in length while the central roller is elongated and has a small diameter. Thus, when the first and second shafts are placed in operative relation, the respective outer rollers and central rollers are aligned in opposed relation and a generally V-shaped configuration is defined. A set of belts are received around the rollers to define the endless loop members of the upper and lower conveyors.

One undesirable aspect of this arrangement is that a multiplicity of rollers must be maintained in inventory. That is, different sized rollers are necessary to impart the V-shaped configuration to the product stream in accordance with the teachings of that patent. At least two sizes of rollers are used and, therefore, an inventory of at least two sizes of rollers are required. This burdens the supplier who must maintain a sufficient supply of rollers on hand. Discounts that may be available if all the rollers were identical in size may not be obtained by manufacturer.

Accordingly, it has been found desirable to provide an alternative apparatus and method for forming a V-shaped configuration in sheet products that overcomes the above-noted problems in an economical, effective manner.

SUMMARY OF THE INVENTION

The present invention contemplates a new and improved apparatus and method for handling signatures, papers, or similar sheet-like products that includes a pair of spaced, generally parallel shafts of respective conveyors that each receive a set of rollers. A first set of rollers on the first shaft includes at least one roller having a rotational axis offset from the axis of the shaft. Likewise, the second set of rollers includes at least one roller having a second rotational axis offset from the second axis of the second shaft.

According to another aspect of the invention, the offset rotational axis arrangement is achieved through use of eccentric members received between the roller and the shaft.

According to another aspect of the invention, all of the rollers of the first set are of substantially uniform diameter, all of the rollers of the second set of substantially uniform diameter, and preferably the rollers from the first and second sets are of substantially uniform diameter.

According to still another aspect of the invention, each roller has an eccentric member interposed between it and its associated shaft to easily provide for the desired offset that achieves a V-shaped configuration.

A principal advantage of the invention is the ability to improve the handling of sheet products without unnecessarily complicating the structure of the assembly.

Another advantage of the invention is related to the reduction of parts required in to be maintained in inventory.

Still another advantage of the invention is the ease of assembly and adjustment if so desired.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment and method of which will be described in detail in this specification and illustrated in the accompanying drawings which form a part hereof, and wherein.

DETAILED DESCRIPTION OF THE PREFERRED EMBODIMENT AND METHOD

Figure 1:
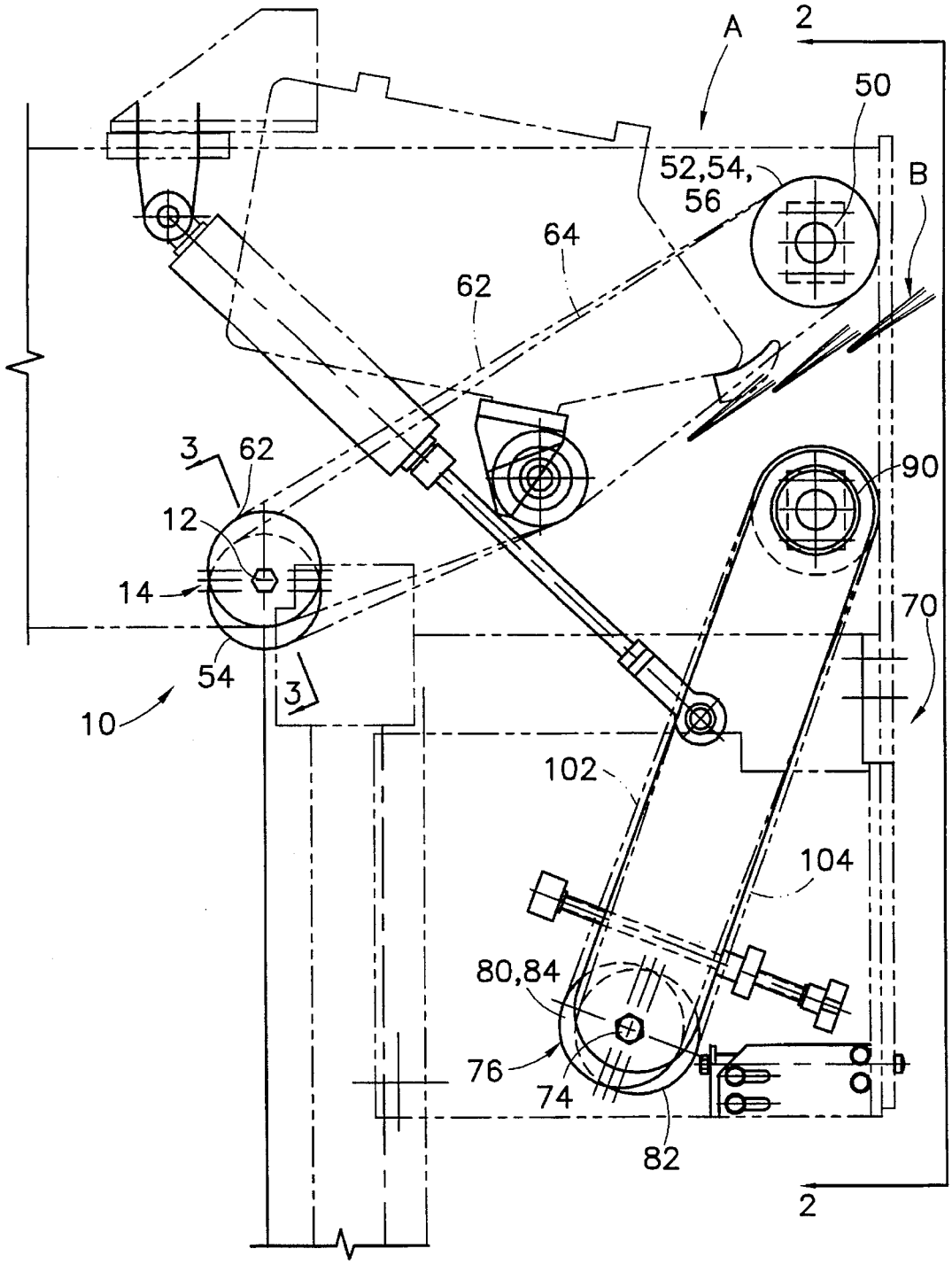
FIG. 1 is a side elevational view of the infeed mechanism in accordance with the subject invention.

Referring now to the drawings wherein the showings are for the purposes of illustrating the preferred embodiment and method of the invention only and not for purposes of limiting same, the FIGURES show an infeed mechanism A for a stacker (not shown) that receives a stream of sheet products B advanced to the stacker. More particularly, and with reference to FIG. 1 and 2, a first or upper conveyor 10 includes a first shaft 12 preferably disposed in horizontal relation that includes a first set 14 of rollers thereon. Typically, the infeed mechanism is secured to an upper portion of the stacker and the first shaft 12 extends between side walls in the stacker upper portion.

Figure 3:
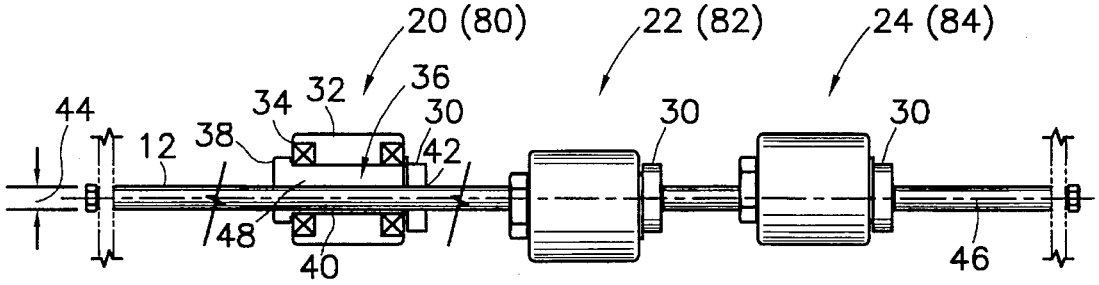
FIG. 3 is a view taken generally along the lines 3—3 of FIG. 1.

As more particularly shown in FIG. 3, the first set 14 of rollers are preferably comprised of first, second, and third rollers 20, 22, 24, respectively. Preferably, the rollers are equally spaced along the first shaft, although unequal spacing may be preferred for a particular application. The rollers 20–24 are of uniform diameter and uniform length and are each fixed against longitudinal movement by a clamp collar 30. Each roller is defined by a tubular roller member 32 having a smooth cylindrical outer surface. The inner cylindrical surface is supported by bearings 34 that are interposed between the roller and an eccentric member 36. In accordance with the preferred arrangement, the eccentric member has an enlarged diameter first end 38, a constant diameter central portion 40 received in the roller member, and a reduced diameter second end 42 received in and secured by the collar 30.

The eccentric members of the first, second, and third rollers are mounted so that a substantial offset represented by numeral 44 is defined between the rotational axis of the outer first and third rollers 20, 24 and the rotational axis of the second roller 22. Because of the provision of the eccentric member between the rollers and the shaft, none of the rotational axes of the first roller set is aligned with the longitudinal axis 46 of the first shaft 12. Instead, a major portion 48 of the eccentric members will be similarly oriented on the outer rollers while the major portion 48 of the second or central roller will be approximately 180° out of phase, or diametrically opposed to the major portion of the outer rollers. This provides for the maximum offset 44 between the rotational axes of the three rollers. In the preferred arrangement, this offset 44 is approximately one-half inch. This dimension, however, should not be deemed to be limiting.

It is also preferred that all three rollers include eccentric members. However, it is contemplated that only one of the rollers, or only a pair of the rollers, from the first set could include eccentric members to achieve the desired offset which provides the V-shaped configuration.

Referring again to FIG. 1, the upper conveyor 10 also includes a shaft 50 disposed in a horizontal relationship. The shaft 50 is shown in FIG. 2 as including three rollers 52, 54, 56. These three rollers are of uniform diameter and are also preferably equally spaced apart by the same dimension as the rollers on the first axis. The rollers each receive an endless loop member, here shown as a flat belt 62, 64, 66, therearound. Thus, the rollers 20 and 52 are connected by the first belt 62, the rollers 22 and 54 are connected by the second belt 64, and the rollers 24, 56 are connected by the third belt 66.

Figure 2:
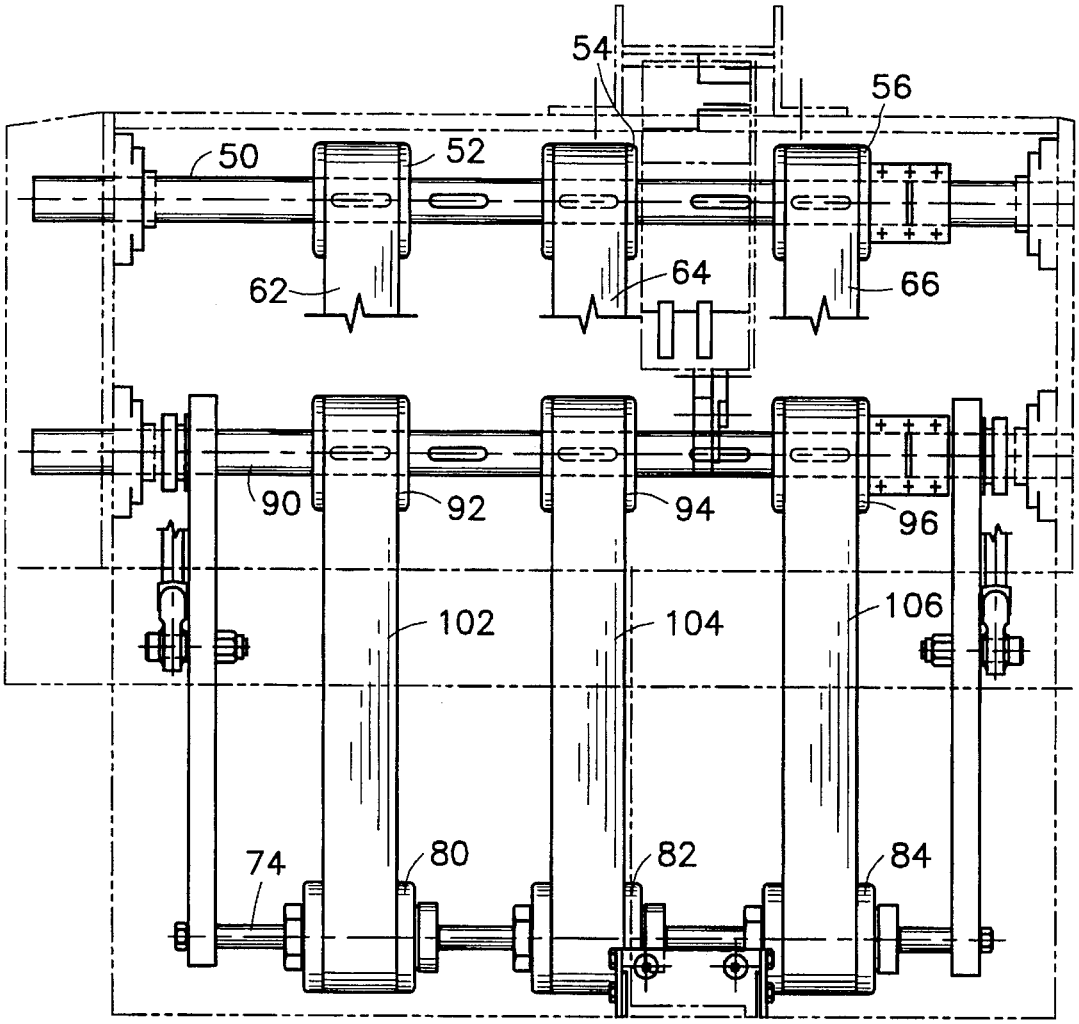
FIG. 2 is a view taken generally along the lines 2—2 of FIG. 1.

During operation, the belt proceeds in a generally clockwise direction as shown in FIG. 1 to advance a stream of articles or sheet products B from an area adjacent shaft 50 toward the first shaft 12 adjacent a chute area of the stacker.

A second or lower conveyor 70 is disposed in spaced relation relative to the first conveyor 10. The second conveyor is additionally adapted for movement between first and second positions. The dump position of the second conveyor is shown in solid line in FIG. 1 where an actuator such as piston/cylinder device 72 selectively pivots the second conveyor so that sheet products are dumped outside the stacker. Thus, if there is a jam or operation of the stacker is otherwise terminated the sheet products will not enter the stacker but instead will be dumped on the floor.

The second conveyor includes a shaft 74 which will hereinafter be referred to as the second shaft. The second shaft 74 includes a second set 76 of rollers, preferably three in number 80, 82, 84. The rollers 80–84 cooperate with the rollers 20, 22, 24 of the first shaft of the upper conveyor to form a nip that imparts the V-shape to the sheet products. The details and description of the rollers 20, 22, 24 and the first shaft in FIG. 3 are equally applicable to the details of the rollers 80, 82, 84 and the second shaft 74. Thus, the outer rollers 80, 84 include eccentric members having major portions disposed on one side of the second shaft while the central roller 82 has the major portion of the eccentric member disposed on the other side of the shaft. This provides for the desired lateral offset between the rotational axes of the second roller and the first and third rollers, as well as the offset relative to the longitudinal axis of the second shaft 74.

Shaft 90 associated with the lower conveyor also has three rollers 92, 94, 96 that cooperate with rollers 80, 82, 84, respectively, via three belts 102, 104, 106. These belts are driven in a generally counterclockwise direction as viewed in FIG. 1 to urge the signature stream toward the stacker. More particular details of the overall operation of such an infeed arrangement for a stacker can be found in U.S. Pat. No. 4,162,733, the details of which are incorporated herein by reference.

As will be appreciated, when the lower conveyor is pivoted upwardly into an operative relation with the upper conveyor assembly, the first and second shafts 12, 74 are closely spaced and in general parallel relation to receive the signature stream therethrough. Rollers 20 and 80, 22 and 82, and 24, 84 are disposed in opposed, operative relation to define a V-shape.

The use of the eccentrics and uniform diameter rollers addresses the inventory concern described above. Likewise, it provides for ease of adjustment since the clamp collar 30 associated with each of the rollers may be loosened for selected rotation of the eccentric member to a desired rotational position on its respective shaft. Thus, by rotating the major portion of the eccentric member of the central roller to be diametrically opposite or 180° out of phase relative to the major portion of the eccentric members for the outer rollers, a maximum offset can be achieved. If it is desired to reduce the offset, the eccentric member of the central roller or the eccentric members of the outer rollers can be rotated to a new orientation to reduce the amount of the offset.

Although the coiled spring wire arrangement has been successfully used in a wide number of applications, A number of manufacturers use belted conveyors and infeed arrangements, although it will be understood that other continuous loop members such as the coiled spring wire arrangement described in U.S. Pat. No. 4,162,733 can be used with equal success. Therefore, although the present invention particularly describes the use of flat belts entrained around a set of rollers, still other continuous loop arrangements could be used without departing from the scope and content of the subject invention.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An apparatus for handling signatures, papers and similar sheet-like products, the apparatus comprising:

first and second shafts disposed in generally parallel relation along first and second axes, respectively;

a first set of rollers received on the first shaft and adapted for rotation thereon, at least one of the rollers from the first set having a first rotational axis offset from the first axis; and a second set of rollers received on the second shaft and adapted for rotation thereon, at least one of the rollers from the second set having a second rotational axis offset from the second axis, the at least one roller of the first and second sets being disposed in cooperative relation with one another for imparting a V-shape to an associated signature.

2. The apparatus as defined in claim 1 wherein the first set of rollers are of substantially uniform diameter.

3. The apparatus as defined in claim 2 wherein the first and second set of rollers are of substantially uniform diameter.

4. The apparatus as defined in claim 1 further comprising a first eccentric member interposed between the at least one roller of the first set and the first shaft.

5. The apparatus as defined in claim 4 further comprising a second eccentric member interposed between the at least one roller of the second set and the second shaft.

6. The apparatus as defined in claim 4 further comprising a second eccentric member interposed between the at least one roller of the second set and the second shaft, the first and second eccentric members being similarly disposed on their respective shafts.

7. The apparatus as defined in claim 1 wherein the first set of rollers include first, second, and third rollers spaced along the first shaft and the second set of rollers include fourth, fifth, and sixth rollers spaced along the second shaft in cooperative relation with the first, second, and third rollers, respectively.

8. The apparatus as defined in claim 7 wherein all six rollers include eccentric members interposed between the respective rollers and the respective first and second shafts.

9. The apparatus as defined in claim 8 wherein the eccentric member associated with the second roller is 180 degrees out of phase with the eccentric members associated with the first and third rollers, and the eccentric member associated with the fifth roller is 180 degrees out of phase with the eccentric members associated with the fourth and sixth rollers.

10. The apparatus as defined in claim 7 wherein at least one roller from the first and second set is 180 degrees out of phase with at least one of the other rollers on the same shaft.

11. The apparatus as defined in claim 1 further comprising continuous loop members disposed about the first set of rollers and cooperating with the signatures for conveying the signatures along a desired path.

12. The apparatus as defined in claim 11 wherein the continuous loop members are defined by flat belts received around the rollers.

13. An apparatus for conveying sheet-like products such as papers, signatures, and the like along a path, the apparatus comprising:

first and second shafts disposed in generally parallel relation;

a first set of rollers disposed on the first shaft, each roller of the first set having the same diameter and including an eccentric member associated with at least one of the rollers of the first set so that a rotational axis of the at least one roller is offset from a rotational axis of another roller of the first set; and a second set of rollers disposed on the second shaft, each roller of the second set having the same diameter and including an eccentric member associated with at least one of the rollers of the second set so that a rotational axis of the at least one roller is offset from a rotational axis of another roller of the second shaft.

14. The apparatus as defined in claim 13 further comprising a continuous belt associated with each roller of the first and second sets.

15. The apparatus as defined in claim 13 wherein all of the rollers of the first set have eccentric members received between the roller and the first shaft, selected ones of the eccentric members being out of phase with the remaining eccentric members of the first set of rollers to impart a non-planar configuration to the products.

16. The apparatus as defined in claim 15 wherein all of the rollers of the second set have eccentric members received between the roller and the second shaft, selected ones of the eccentric members being out of phase with the remaining eccentric members of the second set of rollers to impart a non-planar configuration to the products.

17. The apparatus as defined in claim 13 wherein the rollers of the first set all have substantially the same length.

18. The apparatus as defined in claim 17 wherein the rollers of the second set all have substantially the same length.

19. The apparatus as defined in claim 13 wherein the first set of rollers includes first, second, and third rollers spaced apart along the first shaft.

20. The apparatus as defined in claim 19 wherein the second shaft is mounted for selective movement toward and away from the first shaft to vary the spacing between the first and second roller sets.

21. An apparatus disposed at an infeed portion of a stacker adapted to facilitate handling and feeding of sheet product to the stacker, the apparatus comprising:

a first conveyor assembly including a first shaft having a first set of rollers disposed thereon, the rollers of the first set being of a given diameter and receiving continuous loop belts thereover for advancing the sheet product, a first roller of the first set having a rotational axis offset from and parallel to a longitudinal axis of the first shaft;

a second conveyor assembly disposed adjacent to the first conveyor assembly for receiving the sheet product therebetween, the second conveyor assembly including a second shaft having a second set of rollers disposed thereon, the rollers of the second set being of a given diameter and receiving continuous loop belts thereover, a first roller of the second set having a rotational axis offset from and parallel to a longitudinal axis of the second shaft and being disposed opposite the first roller of the first set to impart a V-shape to the sheet product as it passes between the first and second rollers.

22. A method of processing a deformable moving sheet product in a paper handling apparatus, the method comprising the steps of:

receiving a leading edge of the moving sheet product between a first pair of opposing first and second rollers each rotatable about respective first and second axes of rotation;

receiving the leading edge of the moving sheet product between a second pair of opposing third and fourth rollers each rotatable about respective third and fourth axes of rotation to impart a non-planar configuration to the sheet product;

mounting said first and third rollers on a first common shaft;

mounting said second and fourth rollers on a second common shaft substantially parallel to said first common shaft; and displacing the axes of rotation of said first and third rollers given radial distances from respective axes of said first and second common shafts so that a sheet product passing between said first and third rollers and between said second and fourth rollers has a non-planar configuration imparted thereto.

23. A method of processing a deformable moving sheet product in a paper handling apparatus, whereby a leading edge of the sheet product passes between a first pair of opposing first and second rollers and between a second pair of opposing third and fourth rollers, said method comprising the steps of:

mounting said first and third rollers upon a first common shaft;

mounting said second and fourth rollers upon a second common shaft;

displacing an axis of rotation of one of said first and third rollers from a longitudinal axis of said first common shaft and displacing an axis of rotation of one of said second and fourth rollers from a longitudinal axis of said second common shaft so that a non-planar configuration is imparted to the sheet product as the rollers are rotated.

24. A method of processing a deformable moving sheet product in a paper handling apparatus whereby a leading edge of the sheet product passes between a first pair of opposing first and second rollers and between a second pair of opposing third and fourth rollers and between a third pair of fifth and sixth rollers, said method comprising the steps of:

mounting said first, third and fifth rollers upon a first common shaft, said third roller being between said first and fifth rollers;

mounting said second, fourth and sixth rollers upon a second common shaft, said fourth roller being between said second and sixth rollers;

displacing an axis of rotation of said third roller from a longitudinal axis of said first common shaft and displacing an axis of rotation of said fourth roller from a longitudinal axis of said second common shaft so that a V-shaped configuration is imparted to the sheet product as the rollers are rotated.

25. A method of processing a deformable moving sheet product in a paper handling apparatus whereby a leading edge of the sheet product passes between a first pair of opposing first and second rollers and between a second pair of opposing third and fourth rollers and between a third pair of fifth and sixth rollers, said method comprising the steps of:

mounting said first, third and fifth rollers upon a first common shaft, said third roller being between said first and fifth rollers;

mounting said second, fourth and sixth rollers upon a second common shaft said fourth roller being between said second and sixth rollers;

displacing an axis of rotation of said first and fifth rollers from a longitudinal axis of said first common shaft and displacing an axis of rotation of said second and sixth rollers from a longitudinal axis of said second common shaft so that a V-shaped configuration is imparted to the sheet product as the rollers are rotated.

* * * * *